US011217268B2

(12) United States Patent
Laberge et al.

(10) Patent No.: US 11,217,268 B2
(45) Date of Patent: Jan. 4, 2022

(54) REAL-TIME AUGMENTED HEARING PLATFORM

(71) Applicant: Bose Corporation, Framingham, MA (US)

(72) Inventors: Francois Laberge, Wellesley, MA (US); Charles Stein, Arlington, MA (US); Colin Cowles, Somerville, MA (US); Felix Izarra, Westborough, MA (US); Daniel Sisolak, Frederick, MD (US); Eric J. Freeman, Sutton, MA (US); Aric J. Wax, Watertown, MA (US)

(73) Assignee: Bose Corporation, Framingham, MA (US)

( * ) Notice: Subject to any disclaimer, the term of this patent is extended or adjusted under 35 U.S.C. 154(b) by 132 days.

(21) Appl. No.: 16/675,976

(22) Filed: Nov. 6, 2019

(65) Prior Publication Data

US 2021/0134321 A1 May 6, 2021

(51) Int. Cl.
*G10L 25/84* (2013.01)
*H04R 25/00* (2006.01)

(52) U.S. Cl.
CPC ..... *G10L 25/84* (2013.01); *H04R 25/505* (2013.01)

(58) Field of Classification Search
CPC ..... G10L 25/84; G10L 21/02; G10L 21/0272; G10L 21/003; G10L 21/0208; G10L 2021/02166; H04R 25/505; H04R 1/1041; H04R 5/033; H04R 5/04; H04R 1/1083; H04R 3/00; H04R 1/20; H04R 2420/01; H04R 2430/01; H04R 2460/01;
(Continued)

(56) References Cited

U.S. PATENT DOCUMENTS

2015/0304782 A1 10/2015 Zurbrugg
2018/0167715 A1* 6/2018 Graylin ..... H04R 1/1083
2018/0376273 A1* 12/2018 Ojala ..... A63F 13/215

FOREIGN PATENT DOCUMENTS

WO WO-2009077665 A1 * 6/2009 ..... H03G 3/32

OTHER PUBLICATIONS

Invitation To Pay Additional Fees and, Where Applicable, Protest Fee; International Patent Application No. PCT/US2020/053266, pp. 1-11, dated Dec. 16, 2020.
(Continued)

*Primary Examiner* — Yogeshkumar Patel
(74) *Attorney, Agent, or Firm* — Bond, Schoeneck & King

(57) ABSTRACT

An audio system and method for generating improved augmented hearing effects in real-time. The system includes a wearable audio device arranged to obtain audio that includes a voice signal associated with a user and an environmental signal associated with other audio picked up by the wearable audio device that does not includes the user's voice. In some implementations, at least one processor of the wearable audio device is configured to isolate the voice signal from the environmental signal such that augmented hearing effects can be applied to the voice signal and/or the environmental signal, independently. In some implementations, augmented hearing effects are designated by a signal augmentation profile generated or stored in the wearable audio device such that the total time between receipt of the audio signal and the modifications and/or transformations to the respective audio signals does not exceed 100 ms.

19 Claims, 7 Drawing Sheets

(58) Field of Classification Search
CPC ..... H04R 2201/107; G10K 11/17885; G10K 11/17827; G10K 2210/1081; G06F 3/165; H03G 3/32
See application file for complete search history.

(56) References Cited

OTHER PUBLICATIONS

International Search Report and the Written Opinion of the International Searching Authority, International Patent Application No. PCT/US2020/053266, pp. 1-17, dated Feb. 9, 2021.

* cited by examiner

REAL-TIME AUGMENTED HEARING PLATFORM

BACKGROUND

This disclosure generally relates to augmented hearing platforms, specifically, to augmented hearing platforms using wearable audio devices.

Known methods of augmented audio signal processing include a form universal processing to all subjects or audio sources within a given audio signal. For example, should a user of a wearable audio device be speaking within an environment with other people or objects that make noise present, typical systems may apply filters or other Digital Signal Processing (DSP) techniques universally to the audio signal such that any effect made alters the audio signal in its entirety including the user's voice and any environmental noise.

Additionally, typical methods of generating augmented hearing effects involve receiving audio from an environment with an audio input of a device, forwarding the audio signal associated with the audio from the environment to a device capable of processing, altering, or modifying the audio signal with the desired hearing effect, sending the augmented audio signal back to the device which originally obtained the audio from the environment, and generation of an audio playback using the augmented audio signal. Due to the fact that the signal processing occurs on another device than the device that originally received the audio from the environment, the latency of the entire system is increased and user perception of the augmented hearing effect is increased to undesirable levels. If these communications utilize Bluetooth Classic or Bluetooth Low Energy (BLE) as a communication protocol, the round-trip time for all communications described can be in excess of 200 ms which can be perceived by the user as a noticeable time-lag.

SUMMARY OF THE DISCLOSURE

The present disclosure is directed to an audio system and method for generating improved augmented hearing effects in real-time. The system includes a wearable audio device arranged to obtain an audio signal from the environment where the audio signal includes a voice signal associated with a user's voice that is wearing the wearable audio device and where the environmental signal is associated with other noises produced within the environment that do not include the user's voice. A processor arranged within the wearable audio device is configured to isolate the voice signal from the environmental signal and separate each signal into respective audio channels such that augmented hearing effects can be applied to the voice signal and/or the environmental signal in an audio output signal, independently. Additionally, the augmented hearing effects are predetermined by a signal augmentation profile generated or stored in the wearable audio device such that the total time between receipt of the audio signal and the modifications and transformations (collectively referred to as augmented hearing effects) discussed herein, does not exceed 100 ms. As 100 ms is below the threshold for detection through human perception, this decreased latency provides an enhanced user augmented reality experience.

In one aspect, there is provided a wearable audio device for modifying an audio signal which includes at least one microphone arranged to receive an audio signal comprising a voice signal of a user wearing the wearable audio device and an environmental signal, at least one audio output device arranged on, in, or in proximity to the wearable audio device, the at least one audio output device arranged to generate an audio output signal and at least one processor, The at least one processor is arranged to: receive the audio signal from the at least one microphone; isolate the voice signal from the environmental signal; modify the voice signal and/or the environmental signal; and generate the audio output signal, wherein the audio output signal comprises the modified voice signal and/or the modified environmental signal the isolation and modification happen in real-time. In one example, a total time period between the receipt of the audio signal from the plurality of audio inputs to the generation of the audio output signal is less than or equal to 100 milliseconds.

In one example, the wearable audio device is arranged to receive a signal augmentation profile, wherein the signal augmentation profile is used by the processor when isolating the voice signal from the environmental signal and modifying the voice signal and/or the environmental signal.

In one example, the signal augmentation profile is received at a first time, and the step of isolating the voice signal from the environmental signal is conducted at a second time after the first time.

In one example, the modified voice signal is provided by a first audio channel.

In one example, the modified environmental signal is provided within a second audio channel different from the first audio channel.

In one example, the modification of the voice signal and/or the environmental signal includes modification of at least one of: a frequency-shift, a time-shift, a spatialization-shift, a gain modification, an equalization modification, an echo modification, an auto-tune modification, or a reverberation modification.

In one example, the processor is further configured to in response to user input to switch the wearable audio device from a non-modified state to a modified state, wherein the modified state includes: receiving the audio signal from the environment; isolating the voice signal from the environmental signal; modifying the voice signal and/or the environmental signal; and generating the audio output signal, wherein the audio output signal comprises the modified voice signal and/or the modified environmental signal.

In one example, the processor is further configured to: identify an audio event within the audio signal; transform audio associated with the audio event; and generate the audio output signal, wherein the audio output signal further comprises the transformed audio associated with the audio event.

In one example, the audio associated with the audio event is not generated in the audio output signal, such that it is completely replaced by the transformed audio associated with that audio event.

In one example, the wearable audio device further comprises an active noise reduction (ANR) module or a noise cancelling (NC) module.

In another aspect, a method foe modifying an audio signal is provided, the method including receiving, at least one microphone of a wearable audio device, an audio signal comprising a voice signal of a user wearing the wearable audio device and an environmental signal; isolating, via a processor, the voice signal from the environmental signal; modifying, using the processor, the voice signal and/or the environmental signal; and generating, via at least one audio output device arranged on, in, or in proximity to the wearable audio device, an audio output signal, wherein the audio output signal comprises the modified voice signal and/or the modified environmental signal.

In one example, a total time period between the receipt of the audio signal from the plurality of audio inputs to the generation of the audio output signal is less than or equal to 100 milliseconds.

In one example, the wearable audio device is arranged to receive a signal augmentation profile at a first time, wherein the signal augmentation profile used by the processor when isolating the voice signal at a second time after the first time from the environmental signal and modifying the voice signal and/or the environmental signal.

In one example, the modified voice signal is provided by a first audio channel and the modified environmental signal is provided by a second audio channel different than the first audio channel.

In one example, the modification of the voice signal and/or the environmental signal includes modification of at least one of: a frequency-shift, a time-shift, a spatialization-shift, a gain modification, an equalization modification, an echo modification, an auto-tune modification, or a reverberation modification.

In one example, the audio signal may include an audio event signal associated with an audio event and wherein processor is further arranged to: identify and audio event from the audio event signal; transform the audio event signal associated with the audio event; and generate the audio output signal, wherein the audio output signal further comprises the transformed audio associated with the audio event signal.

In another aspect, a computer program product stored on a non-transitory computer-readable medium which includes a set of non-transitory computer-readable instructions for modifying an audio signal is provided, that when executed on a processor of a wearable audio device is arranged to: receive, via at least one microphone, an audio signal from an environment comprising a voice signal of a user wearing the wearable audio device and an environmental signal; isolate the voice signal from the environmental signal; modify the voice signal and/or the environmental signal; and generate, via at least one audio output device arranged on, in, or in proximity to the wearable audio device, an audio output signal, wherein the audio output signal comprises the modified voice signal and/or the modified environmental signal.

In one example, a total time period between the receipt of the audio signal from the plurality of audio inputs to the generation of the audio output signal is less than or equal to 100 milliseconds.

In one example, the wearable audio device is arranged to receive a signal augmentation profile at a first time, wherein the signal augmentation profile used by the processor when isolating the voice signal at a second time after the first time from the environmental signal and modifying the voice signal and/or the environmental signal.

In one example, the modified voice signal is provided by a first audio channel and the modified environmental signal is provided by a second audio channel different than the first audio channel.

In one example, the modification of the voice signal and/or the environmental signal includes modification of at least one of: a frequency-shift, a time-shift, a spatialization-shift, a gain modification, an equalization modification, an echo modification, an auto-tune modification, and a reverberation modification.

In one example, the audio signal may include an audio event signal associated with an audio event and wherein processor is further arranged to: identify an audio event signal associated with the audio event; transform the audio event signal associated with the audio event; and generate the audio output signal, wherein the audio output signal further comprises the transformed audio associated with the audio event signal.

These and other aspects of the various embodiments will be apparent from and elucidated with reference to the aspect(s) described hereinafter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the various aspects.

DETAILED DESCRIPTION

Figure 1:
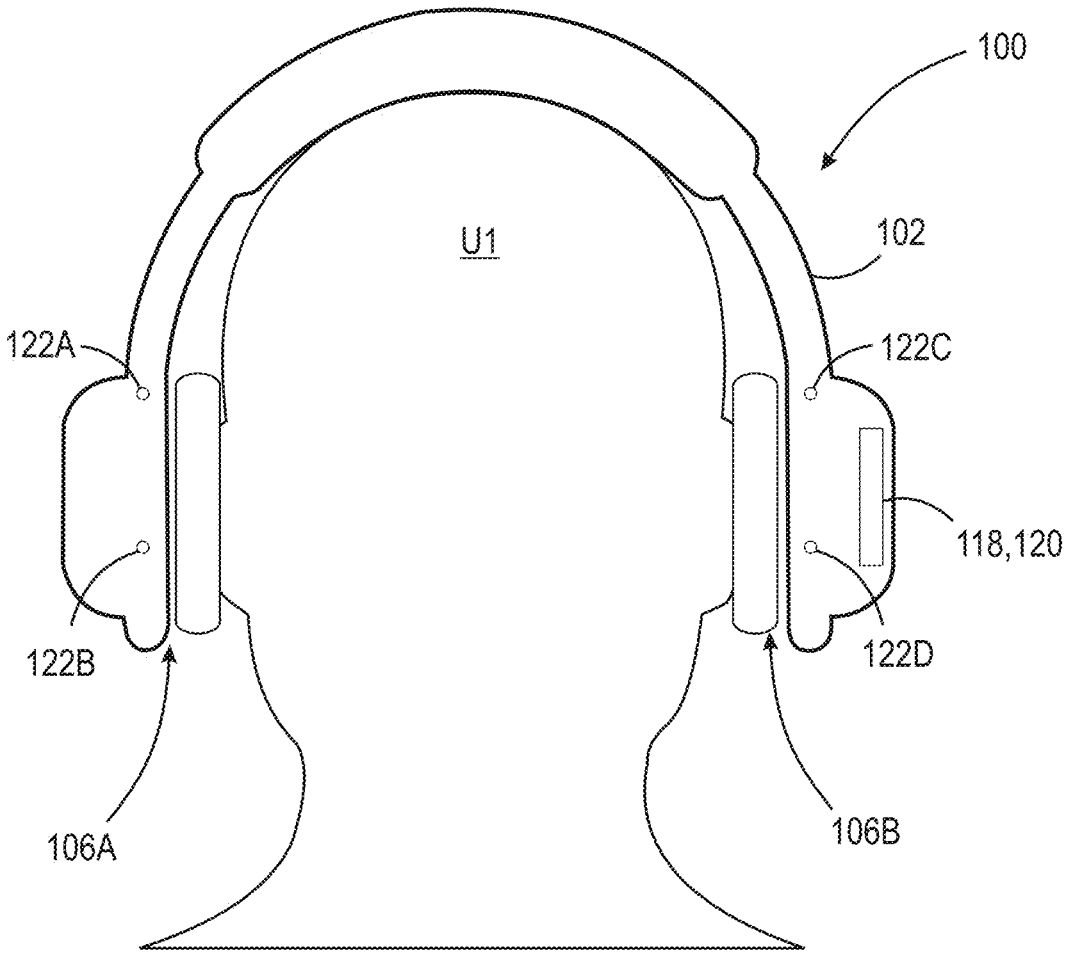
FIG. 1 is a schematic representation of an audio system according to the present disclosure.

The present disclosure is directed to an audio system and method for generating improved augmented hearing effects in real-time. The system includes a wearable audio device arranged to obtain an audio signal from the environment where the audio signal includes a voice signal associated with a user's voice that is wearing the wearable audio device and where the environmental signal is associated with other noises produced within the environment that do not include the user's voice. A processor arranged within the wearable audio device is configured to isolate the voice signal from the environmental signal and separate each signal into respective audio channels such that augmented hearing effects can be applied to the voice signal and/or the environmental signal in an audio output signal, independently. Additionally, the augmented hearing effects are predetermined by a signal augmentation profile generated or stored in the wearable audio device such that the total time between receipt of the audio signal and the modifications and transformations (collectively referred to as augmented hearing effects) discussed herein, does not exceed 100 ms.

The techniques, methods, and systems provided herein provide numerous benefits. For example, as the 100 ms threshold discussed above is below the threshold for detection through human perception, this decreased latency provides an enhanced user augmented reality experience, in that, real-time processing can occur without a noticeable lag in audio rendering. Additionally, the separation of the voice signal and the environmental signal discussed below into two separate channels, i.e., a first channel and a second channel, allows for independent modifications and/or transformations to the voice signal, the environmental signal, or both. Furthermore, the ability to separate the voice signal from the environmental signal allows for complete transformation or complete replacement of the subject of an audio event within an environment such that a given audio event can be replaced by any predetermined audio event in real-time. These advantages and techniques will be described in detail below.

The present disclosure utilizes a binaural microphone pickup, active noise reduction, and/or noise cancelling techniques. The present disclosure can potentially utilize a combination of these techniques to achieve an "augmented hearing" effect, by transforming incoming audio in real-time. There are two distinct examples in which this is achieved, one specifically for self-voice changing, and one for altering the way the user perceives their whole environment. In the first example, the derived signal from the wearable audio device's voice pickup—after beamforming to the mouth and processing—is sent to an application which uses the input in any manner it chooses, typically Digital Signal Processing (DSP), to produce its own signal which is played back in the wearable audio device (in ideally under 50 ms) in place of the original signal (which is blocked out using Active Noise Reduction (ANR)). This achieves the effect of the user hearing their own voice in a modified manner, in perceived real-time. In the second example, the process is the same, except the signal sent to the application is the stereo feed derived from the wearable audio device's binaural microphone pickups and signal processing (which achieves a pristine, natural feed of the surrounding environment), instead of the voice pickup. This way the user hears their reality altered in whatever manner the application sees fit, maintaining spatial awareness of their surroundings. Latency can be higher if the application's focus is not on augmented self-voice, but most effects should not be over 100 ms, for example, or any other latency that is perceivable by the user. Techniques in which the application can augment the user's reality can widely vary, for example, constant signal processing to consistently alter how every aspect reality sounds, or using real-world audio events to trigger artificial sounds, which are spatially placed to sound like they are coming from the physical audio. The processing itself can be done either embedded within the wearable audio device or on any peripheral device which supports USB-Audio. With the former technique, the application must send up the audio-processing to be run in the wearable audio device's firmware, and it must be able to run in the limited space available on the wearable audio device's memory. The benefits include a wireless design, lower latency, and the ability to send the augmented signal to a connected Bluetooth device as the default microphone feed. With the latter technique, a USB-C cable is utilized, but in return the application can use the vastly superior Central Processing Unit (CPU) and Graphical Processing Unit (GPU) processing and memory of the peripheral device.

The term "wearable audio device", as used in this application, is intended to mean a device that fits around, on, in, or near an ear (including open-ear audio devices worn on the head, neck, or shoulders of a user) and that radiates acoustic energy into or towards the ear. Wearable audio devices are sometimes referred to as headphones, earphones, earpieces, headsets, earbuds or sport headphones, and can be wired or wireless. A wearable audio device includes an acoustic driver to transduce audio signals to acoustic energy. The acoustic driver may be housed in an earcup. While some of the figures and descriptions following may show a single wearable audio device, having a pair of earcups (each including an acoustic driver) it should be appreciated that a wearable audio device may be a single stand-alone unit having only one earcup. Each earcup of the wearable audio device may be connected mechanically to another earcup or headphone, for example by a headband and/or by leads that conduct audio signals to an acoustic driver in the ear cup or headphone. A wearable audio device may include components for wirelessly receiving audio signals. A wearable audio device may include components of an active noise reduction (ANR) system. Wearable audio devices may also include other functionality such as a microphone so that they can function as a headset. While FIG. 1 shows an example of an around-ear form factor, in other examples the headset may be an audio eyeglass form factor, an in-ear, on-ear, or near-ear headset. In some examples, a wearable audio device may be an open-ear device that includes an acoustic driver to radiate acoustic energy towards the ear while leaving the ear open to its environment and surroundings.

Figure 2:
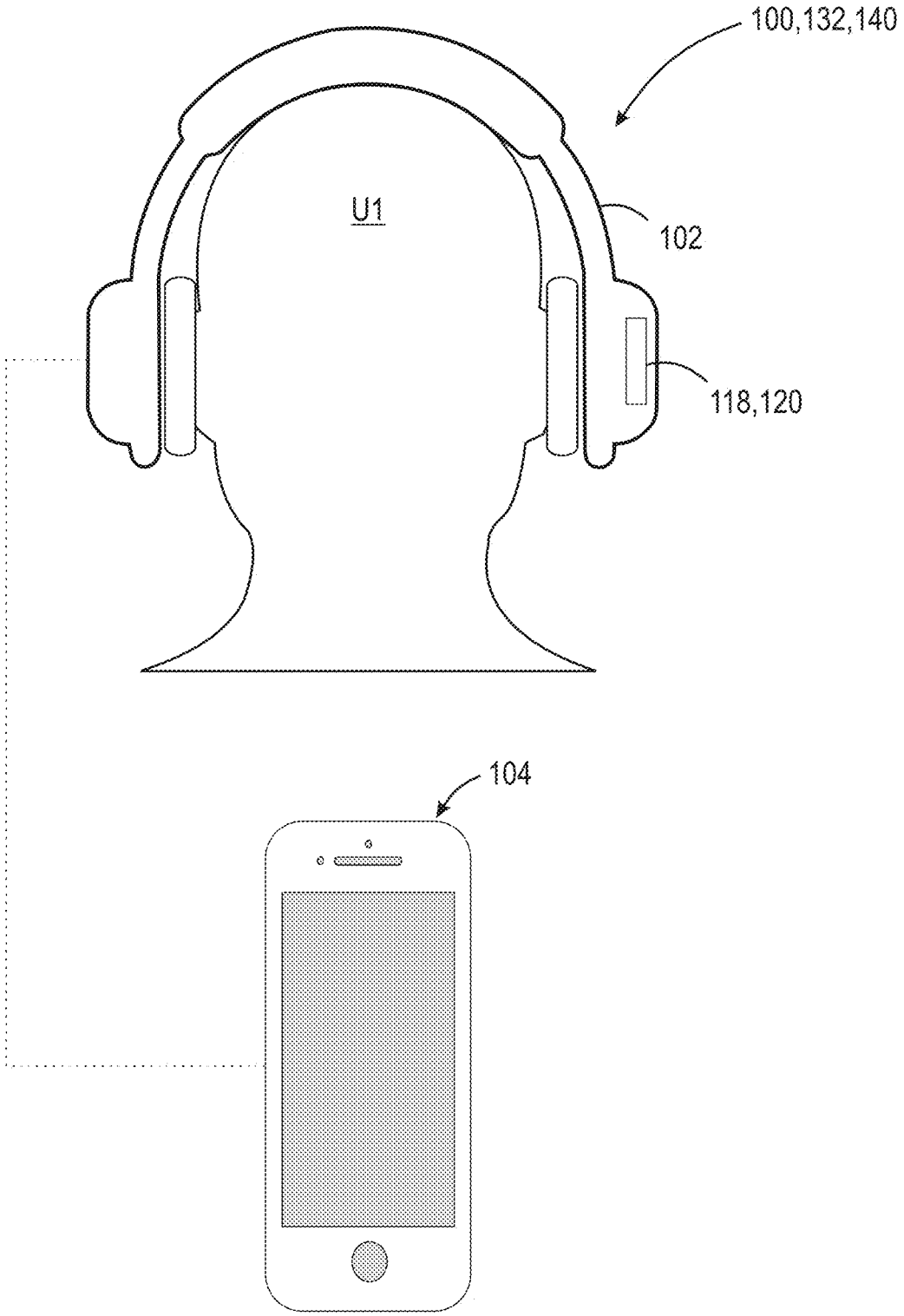
FIG. 2 is a schematic representation of an audio system according to the present disclosure.

The following description should be read in view of FIGS. 1-2. FIG. 1 is a schematic view of wearable audio device 102 of audio system 100 according to the present disclosure. As illustrated in FIG. 2, audio system 100 can further include a peripheral device 104 arranged in communication with wearable audio device 102. Although illustrated in FIG. 1 as a pair over-ear headphones, it should be appreciated that wireless audio device 102 could be any type of headphone or wearable device capable of establishing a wireless or wired data connection with peripheral device 104, and/or capable of performing the modifications and transformations to the voice and environmental signals discussed below. Additionally, although peripheral device 104 is illustrated and described as a mobile communication device, e.g., a smart phone, it should be appreciated that peripheral device 104 can be any external device, i.e., external to wearable audio device 102, e.g., a personal computer, server, cloud-based server, laptop, tablet, smart watch, etc.

Figure 3:
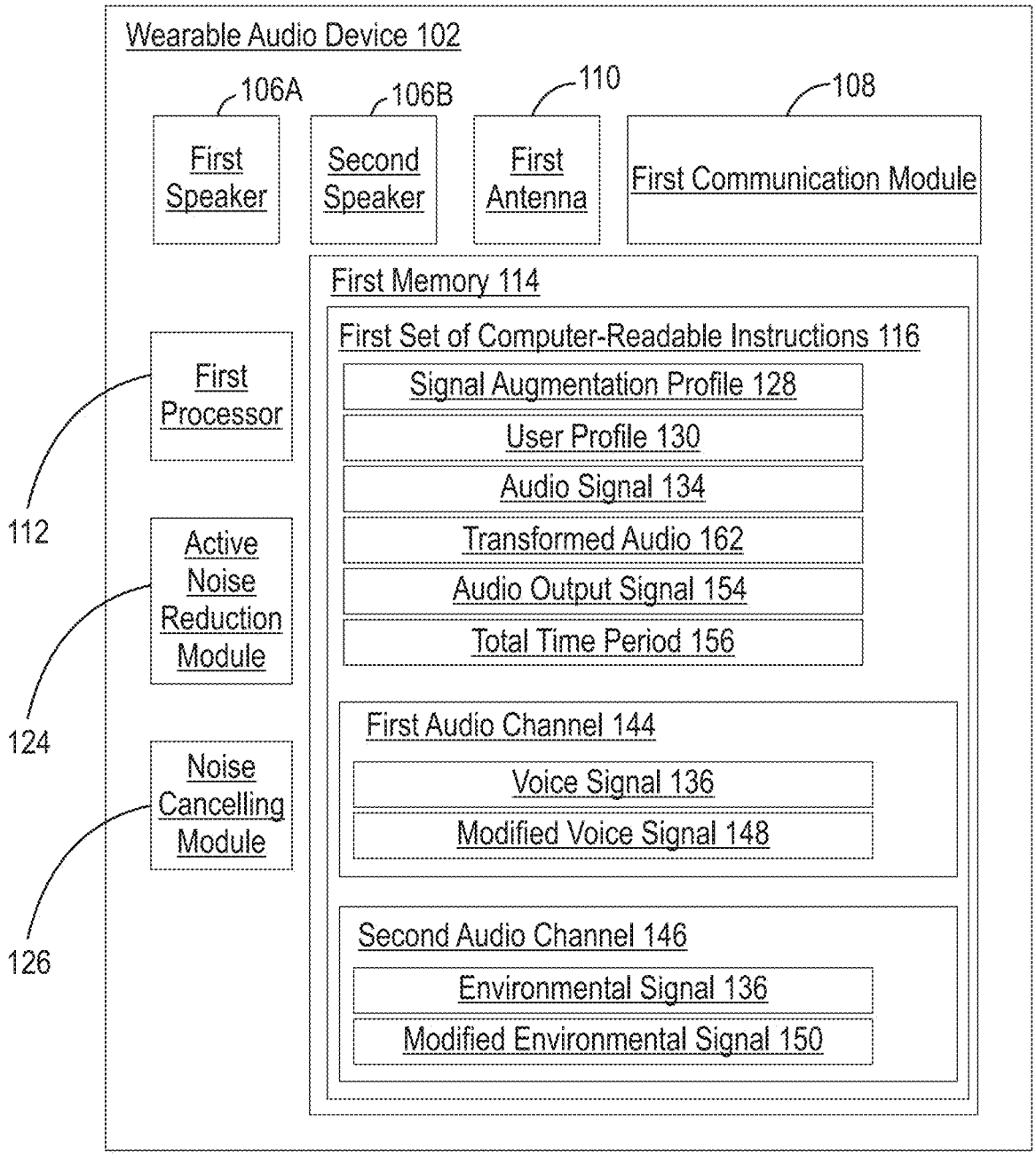
FIG. 3 is a schematic representation of the components of a wearable audio device according to the present disclosure.

Wearable audio device 102 further includes at least one audio output device 106, e.g., a headphone, a speaker, or a transducer, and a first communication module 108 (shown in FIG. 3). In one example, audio output device 106 is a single headphone speaker, i.e., first speaker 106A arranged on or in wearable audio device 102. Although only a single speaker 106A is described throughout the disclosure, it should be appreciated that wearable audio device 102 may include more than one speaker, e.g., first speaker 106A and second speaker 106B. First speaker 106A is arranged to produce an audio output signal 154 (discussed below) proximate at least one ear of a user U1 in response to audio data sent or received from first communication module 108, or more importantly, in response to modification or transformation instructions contained in a signal augmentation profile 128 (discussed below). First communication module 108 is arranged to send and/or receive data between, for example, wearable audio device 102 and peripheral device 104 via an antenna, i.e., first antenna 110 (shown in FIG. 3) or a USB-C cable (not shown). The data received can be, e.g., audio data or communication data (e.g., data related to signal augmentation profile 128) sent and/or received from a plurality of external devices, e.g., peripheral device 104. It should be appreciated, that first communication module 108 can be operatively connected to a first processor 112 (shown in FIG. 3) and first memory 114 (shown in FIG. 3) operatively arranged to execute and store, respectively, a first set of non-transitory computer-readable instructions 116 (shown in FIG. 3) to perform the functions of wearable audio device 102 as will be discussed below, as well as a battery or other power source (not shown).

As shown in FIGS. 1 and 2, wearable audio device 102 further includes a first user interface 118 having at least one user input 120. It should be appreciated that, although illustrated in FIGS. 1 and 2 schematically, user input 120 can refer to any manner of receiving an input from a user U1. For example, user input 120 can be a plurality of touch capacitive sensors, or a series of buttons or slideable switches. Additionally, as will be discussed below, the term "user input" is intended to mean any form of input from a user or a user's condition. For example, although "user input" can correspond to a physical interaction with user interface 118 from the user U1, it should be appreciated that the user can also generate "user input" from a voice command (received by at least one of plurality of microphones 122A-122D discussed below), a gesture or other motion-based action received by a sensor, e.g., a gyroscope, accelerometer, magnetometer, or the user's location, e.g., using Global Positioning Systems (GPS) or other location-based data.

Wearable audio device 102 can further include a plurality of microphones 122A-122D. As illustrated in FIG. 1, plurality of microphones 122A-122D can be configured such that there is at least two microphones on either side of user U1's head, e.g., a first and second microphone 122A-122B arranged on the right side of the user's head and a third and fourth microphone 122C-122D arranged on the left side of the user's head. It should also be appreciated that the pairs of microphones on either side of the user's head are arranged such that when viewing the user's head and wearable audio device 102 from either side, an imaginary line can be drawn connecting the user's mouth and both microphones of each pair. This orientation and alignment increases the accuracy of voice pick-up by each pair of microphone and utilizes beam forming techniques to clearly distinguish the user's voice from environmental noise (discussed below). While the techniques described herein could be achieved using only one microphone, it is beneficial to use multiple microphones for audio pickup to help with the separation between the user's self-voice and audio from the environment, as can be appreciated based on this disclosure.

Additionally, as illustrated schematically in FIG. 3, wearable audio device 102 further includes an active noise reduction module 124 and/or a noise cancelling module 126. Active noise reduction module 124 is arranged to receive an input audio signal, e.g., from at least one of the plurality of microphones 122A-122D, and process/modify/transform (as will be discussed below) the input audio signal and generate, using, for example, an audio output device, e.g., first speaker 106A, a processed, modified, or transformed audio signal such that the user may perceive audio or noise occurring in real-time within an environment E differently than what is actually occurring. Similarly, noise cancelling module 126 can be arranged to process or modify an audio input received by, e.g., at least one microphone of plurality of microphones 122A-122D, from within the environment E, and suppress, eliminate, filter, or otherwise reduce the amount of audio (i.e., the volume) that reaches the ears of the user U1.

As discussed above, a user of the wearable audio device 102 can establish, create, or otherwise generate a signal augmentation profile 128 either directly on wearable audio device 102, or on a separate device, e.g., peripheral device 104. It should be appreciated that in the event signal augmentation profile 128 is generated using wearable audio device 102, e.g., with user interface 118, signal augmentation profile 128 can be stored within memory 114 on wearable audio device 102 and used for real-time modification or transformation of an input audio signal, e.g., audio signal 134 (discussed below). Furthermore, it should also be appreciated that in the event signal augmentation profile 128 is generated on a separate device, e.g., peripheral device 104, signal augmentation profile 128 can be sent by peripheral device 104 and received via first antenna 110 (if sent wirelessly) or via communication module 108 (if sent via a wired connection) such that signal augmentation profile can be stored within first memory 114 for real-time modification and/or transformation of an audio input signal. Signal augmentation profile 128 is intended to be a series of predefined user settings or instructions on how the user would like events, modifications, alterations, or transformations of a particular audio signal or audio event to be carried out. For example, signal augmentation profile 128 can include a user profile 130 containing identification data related to identifying a particular user's voice within an environment E, e.g., a trained voice profile. Additionally, signal augmentation profile can include instructions to perform at least one of: a frequency-shift, a time-shift, a spatialization-shift, a gain modification, an equalization modification, an echo modification, an auto-tune modification, or a reverberation modification, to the audio input signal 134 as will be discussed below. It should be appreciated that a "time-shift" as discussed herein is intended to mean any change or alteration in the perceived time between the time an event occurred in an environment E and the time at which the user receives the modified signal through first speaker 106A that is greater than the normal latency of the audio system as will be discussed herein. Additionally, a "spatialization-shift," as used herein is intended to mean an alteration, modification, or transformation of the perceived position in space of an input signal within an output signal, e.g., the perceived location of an audio event within environment E. It should further be appreciated that, in furtherance of the real-time processing that will be discussed herein, the generation of signal augmentation profile 128, as well as the sending, receiving, and/or storing of signal augmentation profile 128 within memory 114 of wearable audio device 102 occurs at a first time 132, e.g., prior to receipt of any audio signal 134 as will be discussed below.

As discussed above, at least one of the plurality of microphones 122A-122D is arranged to receive an audio signal 134 from the environment E. Audio signal 134 can include a voice signal 136 of user U1, for example, and environmental signal 138 which may include noises made within the environment that do not include the user's voice, i.e., noises made by other people or objects within in the environment E. As discussed above, processor 112 along with the set of non-transitory computer readable instructions 114 of wearable audio device 102 can, using beamforming techniques isolate the noises made by user U1 while user U1 is speaking within environment E, e.g., to isolate the user's voice signal from the remaining noise, i.e., the noise related to environmental signal 138 such that the voice signal 136 and the environmental signal 138 can be individually modified into a modified voice signal 148 (discussed below) and a modified environmental signal 150 (discussed below) based on the instructions included with signal augmentation profile 128. Alternatively, as will be discussed below, processor 112 can also be arranged to transform voice signal 136 and/or environmental signal 138 completely such that the original noise is completely replaced by a new artificially generated sound within environment E. Note that in some implementations, processor 112 could include multiple processors, but for ease of description, processor 112 is primarily referred to in the singular herein.

It should further be appreciated that wearable audio device 102 can be configured to operate in one of at least two states depending on user input, e.g., a non-modified state 140 and a modified state 142. In the non-modified state 140, wearable audio device 102 is arranged to receive audio signal 134 from environment E which can contain a voice signal 136 and an environmental signal 138. While wearable audio device 102 is operating in the non-modified state 140, processor 112 can be arranged to simply forward, pass, or otherwise transfer the audio signal 138 to audio output device 106A without any signal modification. In one example, when wearable audio device 102 is operating in the non-modified state 140, processor 112 is arranged to isolate voice signal 136 from environmental signal 138 within audio signal 134, and forward, pass, or otherwise transfer the voice signal 136 and the environmental signal 138 to the audio output device 106A without any signal modification. In another example, when wearable audio device 102 is operating in the non-modified state 140, processor 112 is arranged to isolate voice signal 136 from environmental signal 138 within audio signal 134, and forward, pass, or otherwise transfer the voice signal 136 and the environmental signal 138 to the audio output device 106A with signal modification, e.g., using active noise reduction (ANR) module 126 and/or noise cancelling (NC) module 128 but without any further modification or transformation. It should be appreciated that after isolation of voice signal 136 and environmental signal 138, wearable audio device 102 may be arranged to separate voice signal 136 and 138 such that they are transferred, process, modified, and transferred in separate channels within wearable audio device 102, e.g., by a first audio channel 144 and a second audio channel 146, respectively.

Conversely, when wearable audio device 102 is operating in the modified state 142, processor 112 is arranged to isolate voice signal 136 from environmental signal 138 within audio signal 134, and forward, pass, or otherwise transfer the voice signal 136 and the environmental signal 138 to the audio output device 106A with signal modification, for example a modification or transformation as will be discussed below. As used herein, the term modification is intended to mean a alteration, manipulation, or change is an audio signal such that the subject of the original noise or sound that created or generated that signal remains the same after modification than it was prior to modification. As mentioned above, modification can include at least one of: a frequency-shift, a time-shift, a spatialization-shift, a gain modification, an equalization modification, an echo modification, an auto-tune modification, or a reverberation modification to the audio input signal 134. The specific modification to the voice signal 136 or the environmental signal 138 is determined by signal augmentation profile 128 and/or user profile 130 at first time 132, i.e., prior to receiving audio signal 134. While in the modified state 142, the isolated components of audio signal 134, e.g., voice signal 136 and environmental signal 138 may be individually modified, as discussed above, to form a modified voice signal 148 and/or a modified environmental signal 150 at a second time 152 after the first time 132. Modified voice signal 148 and/or modified environmental signal 150 can include a modification using at least one of the modifications discussed above such that the subject of the audio, e.g., a person or an object capable of making noise, remains the same but is altered or modified according to at least one of the modifications discussed above. After modification, processor 112 can be arranged to generate an output audio signal 154 through audio output device 106A which can contain at least one of modified voice signal 136 and modified environmental signal 138 such that the user U1 can perceived the modified audio in real-time.

As used herein, the term "real-time" is intended to refer to a time period or window of time within which a human hearing an audio signal cannot distinguish, visually and/or auditorily, from the sound produced by an event within the environment E and the sound as it is perceived through audio output device 106A. As will be discussed below in detail, the various components of audio system 100 are arranged to receive an audio signal 134 by at least one microphone, e.g., 122A, and process, modify, or transform that audio signal 134 into audio output signal 152 to generate sound to the user within a total time period 156 of less than 100 ms. It should be appreciated that 100 ms is one example of the total time period 156 and that other total time periods are possible, e.g., 10 ms, 20 ms, 30 ms, 40 ms, 50 ms, 75 ms, 125 ms, 150 ms, and 200 ms. In other words the total elapsed time between receipt of audio signal 134 and the time that audio output signal 154 is generated to produce sound via audio output device 106A is less than 100 ms. The advantageous speed of processing the audio signal 134 into audio output signal 154 is largely due to the fact that signal augmentation profile 128 and/or user profile 130 are generated and/or stored within wearable audio device 102 at a first time 132 prior to any modification or receipt of audio signal 134, such that at a second time 152, wearable audio device 102 may quickly process or modify audio signal 134 into audio output signal 154.

It should be appreciated that, the user U1 can determine or designate through a user input 120 whether wearable audio device 102 is operating in non-modified state 140 or modified state 142. For example, user U1 can depress or otherwise engage with user input 120 on user interface 118 which would trigger a switch between non-modified state 140 and modified state 142, or vice versa. Furthermore, as discussed above, the user input that switches between the non-modified state 140 and modified state 142 may be a voice input received by at least one microphone, e.g., first microphone 122A, a predefined time-of-day, e.g., 8:00 AM, 12:00 AM, 2:00 PM, etc., or it may be based on a predefined location, e.g., the location of the wearable audio device 102 in proximity with a building, landmark, or other present location.

Figure 4:
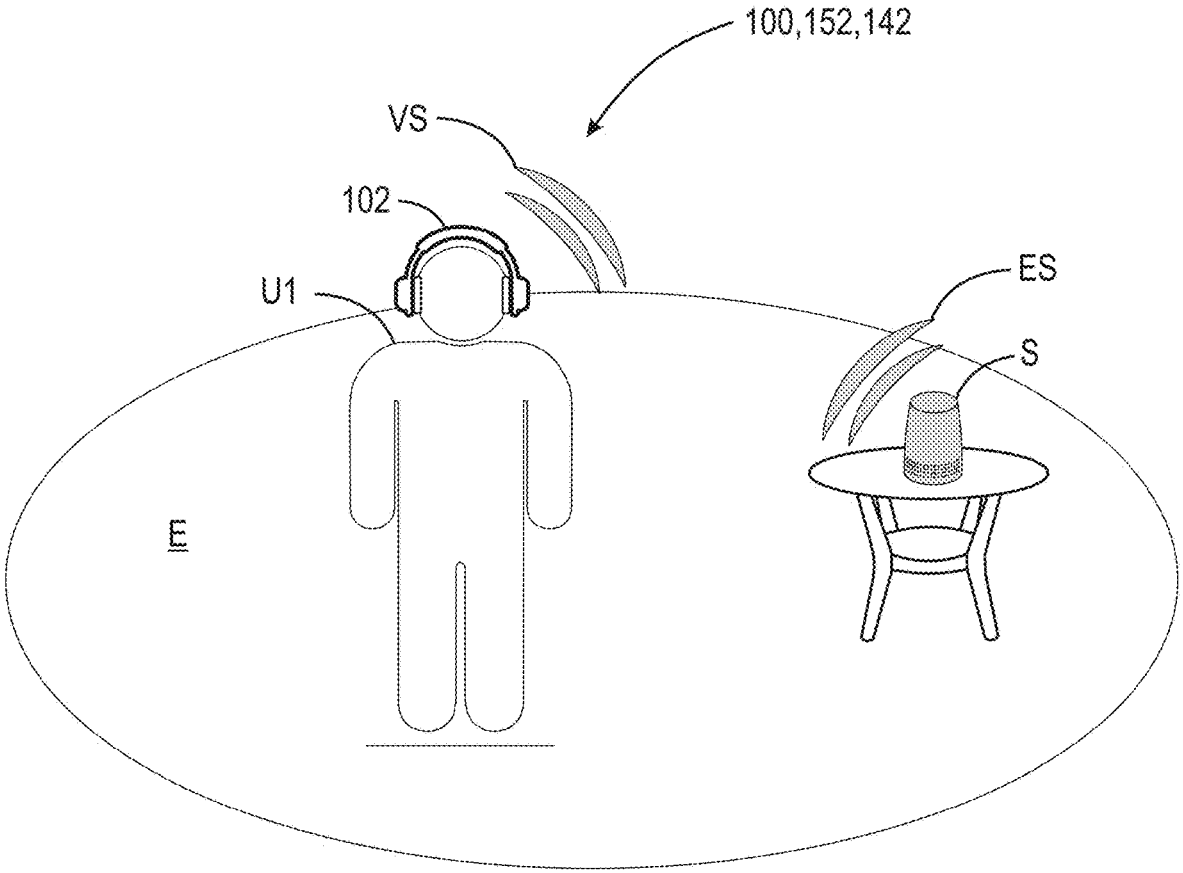
FIG. 4 is a schematic representation of an environment with a user and a sound source according to the present disclosure.

In one example, during operation of audio system 100 and as illustrated in FIG. 4, a first user U1 is portrayed within an environment E. Additionally, within the environment E, audio system 100 can include an external sound source S which contributes to environmental sound ES or background noise within environment E. As illustrated, sound source S is a stand-alone wireless speaker arranged to produce sound which can be, e.g., music, audio corresponding to an audio book, audio relating to a podcast, audio relating to other forms of human speech, etc. Additionally, first user U1 can produce sound with user's voice, i.e., voice sound VS. As discussed above, at a first time 132, i.e., prior to any noise made within environment E, for example, user U1 can generate, upload, or otherwise transfer and store a signal augmentation profile 128 and/or user profile 130 to memory 114 of wearable audio device 102 (wirelessly via first antenna 110 or via a USB-C cable) such that preset preferences, settings, and/or instructions pertaining to how any received audio signal 134 should be modified is stored within wearable audio device 102 at the first time 132. As discussed above, while in the non-modified state 140, processor 112 is arranged to isolate voice signal 136 (corresponding with a voice sound VS of the user U1) from an environmental signal 138 (corresponding with environmental sound ES or other background noise within audio signal 134), and forward, pass, or otherwise transfer the voice signal 136 and the environmental signal 138 to the audio output device 106A with little or no signal modification, e.g., using active noise reduction (ANR) module 126 and/or noise cancelling (NC) module 128, but without any further modification. In the above example, the user U1 can switch operational states of wearable audio device 102 at any time after first time 132 from the non-modified state 140 to the modified state 142 by providing a user input, e.g., user input 120, or a voice command. Additionally, operational states may be switched based on a predetermined a time-of-day or geographical location. Within the modified state 142 processor 112 is arranged to isolate voice signal 136 (corresponding with a voice sound VS of the user U1) from environmental signal 138 (corresponding with environmental sound ES or other background noise within audio signal 134), and forward, pass, or otherwise transfer the voice signal 136 and the environmental signal 138 to the audio output device 106A with a further modification, i.e., a modification that does more than active noise reduction or noise cancelling. For example, processor 112 can, based on the present settings, preferences, or instructions contained in signal augmentation profile 128, generate a modified voice signal 148 and output the modified voice signal 148 to the user through audio output device 106A. Modified voice signal 148 may include a modification to voice signal 136 which includes at least one of: a frequency-shift, a time-shift, a spatialization-shift, a gain modification, an equalization modification, an echo modification, an auto-tune modification, or a reverberation modification.

In one example, signal augmentation profile 128 includes instructions to modify the user's voice signal 136 so that the user U1 perceives their own voice in a higher or lower pitch or frequency than normal using a frequency-shift modification. In one example, signal augmentation profile 128 includes instructions to modify the user's voice signal 136 so that the user U1 perceives their own voice as if projected from a different location within environment E than the location they are actually standing in using a spatialization-shift modification. In another example, signal augmentation profile 128 includes instructions to modify the user's voice signal 136 so that the user U1 perceives their own voice in a louder or quieter than normal using a gain modification. In one example, signal augmentation profile 128 includes instructions to modify the user's voice signal 136 with a combination of the modifications described above to modify their voice according to a preset character or iconic identity, e.g., such that the user perceives themselves speaking as though they were Darth Vader or Mickey Mouse. In other words, such voice modifications are primarily used to change the user's perceived voice to something that is unnatural, as opposed to other techniques that are used to change the user's perceived voice to something that is more natural.

Similarly, the environmental signal 138 corresponding to sound ES once received by at least one microphone of plurality of microphones 122A-122D, can be modified. For example, processor 112 can, based on the present settings, preferences, or instructions contained in signal augmentation profile 128, generate a modified environmental signal 150 and output the modified environmental signal 150 to the user through audio output device 106A. Modified environmental signal 150 may include a modification to voice signal 136 which includes at least one of: a frequency-shift, a time-shift, a spatialization-shift, a gain modification, an equalization modification, an echo modification, an auto-tune modification, or a reverberation modification.

Figure 5:
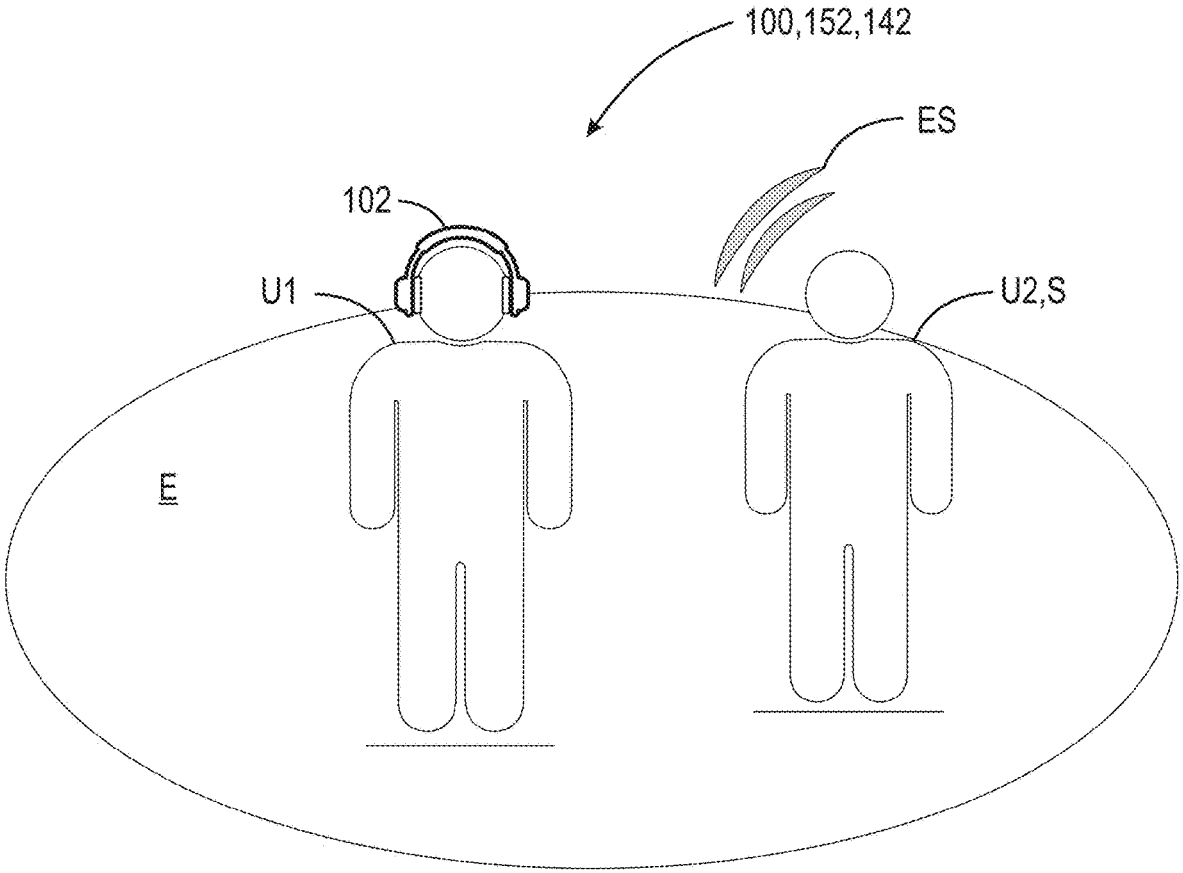
FIG. 5 is a schematic representation of an environment with a user and a sound source according to the present disclosure.

Additionally, and as illustrated in FIG. 5, the environmental signal 138 corresponding to environmental sound ES can include sound produced by other people, e.g., second user U2, and the modification to environmental signal 138 to produce modified environmental signal 150 can include similar modifications as described above with respect to modified voice signal 148 to first user U1's voice, but to second user U2's voice within environment E.

In another example, instead of modifying audio signal 134, e.g., by modifying voice signal 136 and/or environmental signal 138 as described above, processor 112 can be arranged to transform and/or replace an audio event 160 occurring in environment E in real-time. For example, while in the modified state 142 and in conformance with the instructions and settings contained in signal augmentation profile 128 described above, wearable audio device 102 may receive an audio event signal 158 which corresponds with a sound signal produced by an audio event 160 at a first location L1 within environment E. An audio event 160 can include a finger snap (e.g., where first user U1 or other user within environment E snaps their fingers), a clap (e.g., where first user U1 or another user within environment E claps their hands together), or other predefined or preset noise signature that can be readily determined by processor 112 from audio event signal 158. Once the audio event signal 158 is isolated from, e.g., voice signal 136, processor 112 may be arranged to generate a transformed audio signal 162 which can include complete transformation or replacement of the subject of the audio at first location L1 and the subsequent noise or audio signal produced by that subject at first location L1.

Figure 6:
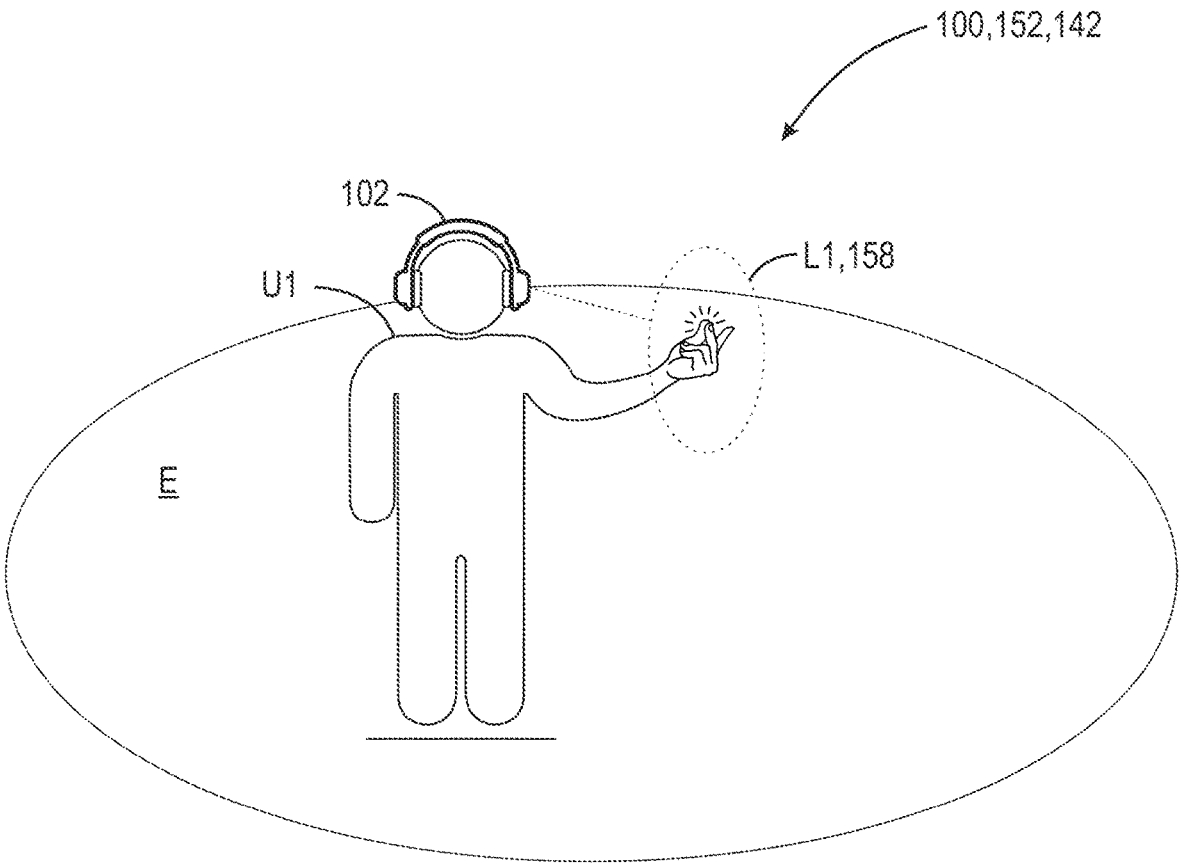
FIG. 6 is a schematic representation of an environment with a user according to the present disclosure.

In one example, during operation of audio system 100 and as illustrated in FIG. 6, a first user U1 is portrayed within an environment E. As discussed above, at a first time 132, i.e., prior to any noise made within environment E, for example, user U1 can generate, upload, or otherwise transfer and store a signal augmentation profile 128 and/or user profile 130 to memory 114 of wearable audio device 102 (wirelessly via first antenna 110 or via a USB-C cable) such that preset preferences, settings, and/or instructions pertaining to how any received audio event signal 158 should be transformed or replaced is stored within wearable audio device 102 at the first time 132. Also as discussed above, the user U1 can switch operational states of wearable audio device 102 at any time after first time 132 from the non-modified state 140 to the modified state 142 by providing a user input, e.g., user input 120, or a voice command. Additionally, operational states may be switched based on a predetermined a time-of-day or geographical location. Within the modified state 142 first user U1 can reach their hand out to their side, e.g., at first location L1, and snap their fingers, i.e., produce audio event 160 corresponding to the noise created by the snap. The sound waves associated with audio event 160 (i.e., the snap) are received by at least one microphone of plurality of microphones 122A-122D and are processed according to the instructions and settings included in signal augmentation profile 128 to transform or replace the sound of first user's U1 snapping fingers with another subject or sound, e.g., a gunshot or car horn, within transformed audio 162 provided to first user U1 through audio output device 106A, such that the user U1 perceives the transformed audio event at first location L1. Importantly, the spatialization of the original subject, e.g., the location of user fingers where the snap was made with respect to first user U1's head, i.e., first location L1, is preserved within transformed audio 162 perfectly replacing the subject of the audio event 160 with a new, different subject in real-time.

Figure 7:
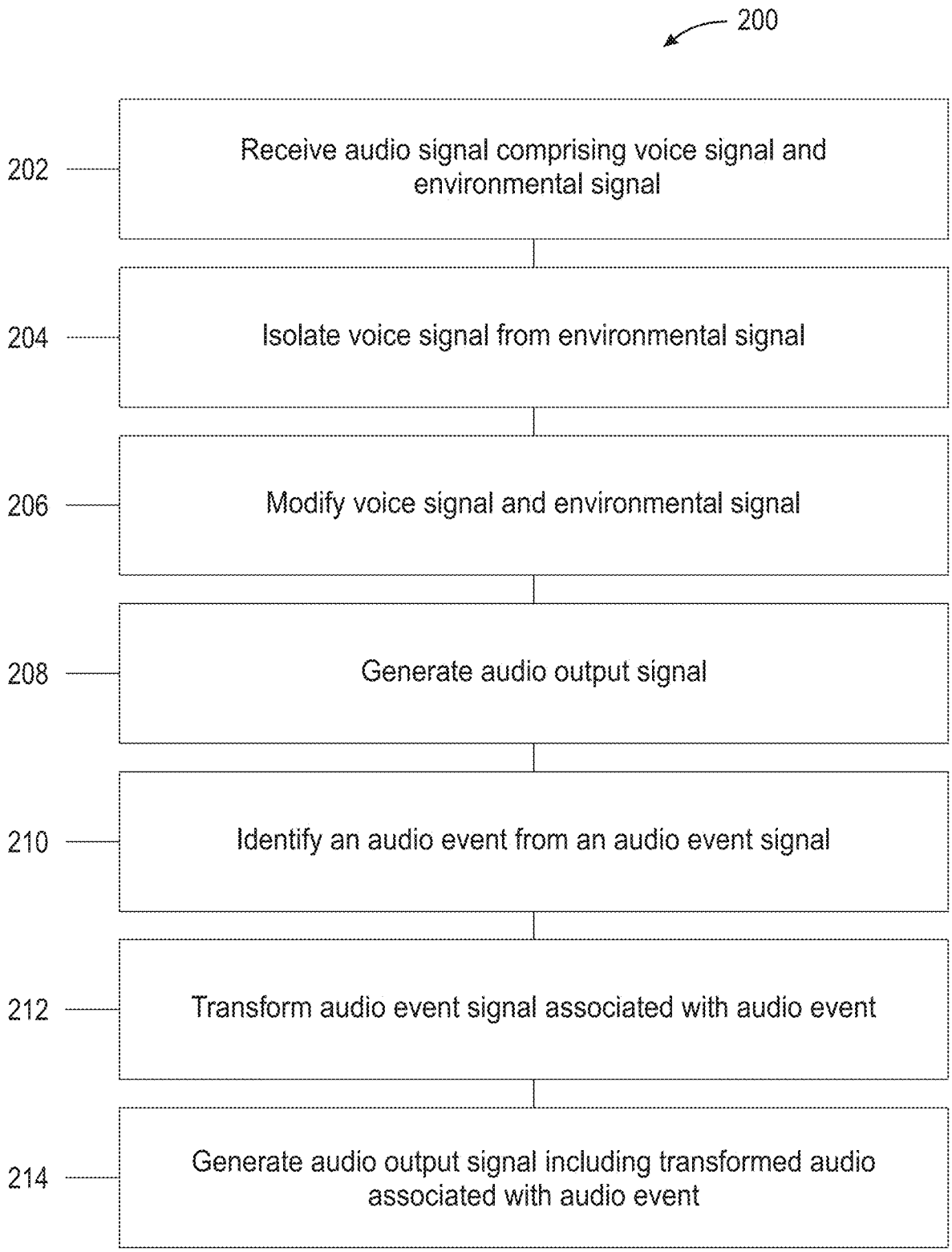
FIG. 7 is a flow chart illustrating the steps of a method according to the present disclosure.

FIG. 7 is a flow chart illustrating the steps a method 200 according to the present disclosure. As illustrated, method 200 can includes, for example: receiving, at least one microphone 122A of a wearable audio device 102, an audio signal 134 comprising a voice signal 136 of a user wearing the wearable audio device and an environmental signal 138 (step 202); isolating, via a processor 118, the voice signal 136 from the environmental signal 138 (step 204); modifying, using the processor 118, the voice signal 136 and/or the environmental signal 138 (step 206)1; and generating, via at least one audio output device 106A arranged on, in, or in proximity to the wearable audio device 102, an audio output signal 154, wherein the audio output signal 154 comprises the modified voice signal 148 and/or the modified environmental signal 150 (step 208). Additionally, or alternatively to generating the audio output signal 154 with modified voice 148 or environmental 150 signals as discussed above, method 200 can include: identifying and audio event 160 from an audio event signal 158 (step 210); transforming the audio event signal 158 associated with the audio event 160 (step 212); and generating the audio output signal 154, wherein the audio output signal 154 further comprises the transformed audio 162 associated with the audio event signal 158 (step 214). In implementations where voice signal 136 and environmental signal 138 are both modified to generate modified voice signal 148 and modified environmental signal 150, the modifications made could be either the same or different. In other words, in such implementations, if a first modification is made to change voice signal 136 to modified voice signal 148 and a second modification is made to change environmental signal 138 to modified environmental signal 150, then the first and second modifications could either be the same (e.g., the same frequency shifting) or different (e.g., a first frequency shifting of the voice signal and a second, different frequency shifting of the environmental signal).

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of" "only one of," or "exactly one of."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

The above-described examples of the described subject matter can be implemented in any of numerous ways. For example, some aspects may be implemented using hardware, software or a combination thereof. When any aspect is implemented at least in part in software, the software code can be executed on any suitable processor or collection of processors, whether provided in a single device or computer or distributed among multiple devices/computers.

The present disclosure may be implemented as a system, a method, and/or a computer program product at any possible technical detail level of integration. The computer program product may include a computer readable storage medium (or media) having computer readable program instructions thereon for causing a processor to carry out aspects of the present disclosure.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present disclosure may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some examples, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present disclosure.

Aspects of the present disclosure are described herein with reference to flowchart illustrations and/or block diagrams of methods, apparatus (systems), and computer program products according to examples of the disclosure. It will be understood that each block of the flowchart illustrations and/or block diagrams, and combinations of blocks in the flowchart illustrations and/or block diagrams, can be implemented by computer readable program instructions.

The computer readable program instructions may be provided to a processor of a, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various examples of the present disclosure. In this regard, each block in the flowchart or block diagrams may represent a module, segment, or portion of instructions, which comprises one or more executable instructions for implementing the specified logical function (s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Other implementations are within the scope of the following claims and other claims to which the applicant may be entitled.

While various examples have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the examples described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific examples described herein. It is, therefore, to be understood that the foregoing examples are presented by way of example only and that, within the scope of the appended claims and equivalents thereto, examples may be practiced otherwise than as specifically described and claimed. Examples of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

What is claimed is:

1. A wearable audio device for modifying an audio signal, comprising:

at least one microphone arranged to receive an audio signal comprising a voice signal of a user wearing the wearable audio device and an environmental signal;

at least one audio output device arranged on or in to the wearable audio device, the at least one audio output device arranged to generate an audio output signal; and at least one processor configured to:

receive the audio signal from the at least one microphone;

isolate the voice signal from the environmental signal;

modify the voice signal and/or the environmental signal; and generate the audio output signal, wherein the audio output signal comprises a mixed audio signal comprising i) the modified voice signal with the environmental signal;

ii) the voice signal with the modified environmental signal; or iii) the modified voice signal with the modified environmental signal.

2. The wearable audio device of claim 1, wherein a total time period between the receipt of the audio signal from the at least one microphone to the generation of the audio output signal is less than or equal to 100 milliseconds.

3. The wearable audio device of claim 1, wherein the wearable audio device is arranged to receive a signal augmentation profile, wherein the signal augmentation profile is used by the processor when isolating the voice signal from the environmental signal and modifying the voice signal and/or the environmental signal.

4. The wearable audio device of claim 3, wherein the signal augmentation profile is received at a first time, and the step of isolating the voice signal from the environmental signal is conducted at a second time after the first time.

5. The wearable audio device of claim 1, wherein the modified voice signal is provided by a first audio channel.

6. The wearable audio device of claim 5, wherein the modified environmental signal is provided by a second audio channel different from the first audio channel.

7. The wearable audio device of claim 1, wherein the modification of the voice signal and/or the environmental signal includes modification of at least one of: a frequency-shift, a time-shift, a spatialization-shift, a gain modification, an equalization modification, an echo modification, an auto-tune modification, or a reverberation modification.

8. The wearable audio device of claim 1, wherein the processor is further configured to, in response to user input, switch the wearable audio device to a non-modified state to a modified state, wherein the non-modified state includes generating the audio output signal without modification or with active noise reduction or active noise cancellation.

9. The wearable audio device of claim 1, wherein the processor is further configured to:

identify an audio event within the audio signal, wherein the audio event corresponds to a predefined or preset noise signature;

transform audio associated with the audio event; and generate the audio output signal, wherein the audio output signal further comprises the transformed audio associated with the audio event.

10. The wearable audio device of claim 9, wherein the audio associated with the audio event is not generated in the audio output signal, such that it is completely replaced by the transformed audio associated with that audio event.

11. The wearable audio device of claim 1, wherein the wearable audio device further comprises an active noise reduction (ANR) module or a noise cancelling (NC) module.

12. A method for modifying an audio signal, comprising:

receiving, via at least one microphone of a wearable audio device, an audio signal comprising a voice signal of a user wearing the wearable audio device and an environmental signal;

isolating, via a processor, the voice signal from the environmental signal;

modifying, using the processor, the voice signal and/or the environmental signal; and generating, via at least one audio output device arranged on, in, or in proximity to the wearable audio device, an audio output signal, wherein the audio output signal comprises a mixed audio signal comprising i) the modified voice signal with the environmental signal; ii) the voice signal with the modified environmental signal; or iii) the modified voice signal with the modified environmental signal.

13. The method of claim 12, wherein a total time period between the receipt of the audio signal from the at least one microphone to the generation of the audio output signal is less than or equal to 100 milliseconds.

14. The method of claim 12, wherein the wearable audio device is arranged to receive a signal augmentation profile at a first time, wherein the signal augmentation profile used by the processor when isolating the voice signal at a second time after the first time from the environmental signal and modifying the voice signal and/or the environmental signal.

15. The method of claim 12, wherein the modified voice signal is provided by a first audio channel and the modified environmental signal is provided by a second audio channel different than the first audio channel.

16. The method of claim 12, wherein the modification of the voice signal and/or the environmental signal includes modification of at least one of: a frequency-shift, a time-shift, a spatialization-shift, a gain modification, an equalization modification, an echo modification, an auto-tune modification, or a reverberation modification.

17. The method of claim 12, wherein the audio signal may include an audio event signal associated with an audio event and wherein processor is further arranged to:

identify the audio event from the audio event signal, wherein the audio event corresponds to a predefined or preset noise signature;

transform the audio event signal associated with the audio event; and generate the audio output signal, wherein the audio output signal further comprises the transformed audio associated with the audio event signal.

18. A computer program product stored on a non-transitory computer-readable medium which includes a set of non-transitory computer-readable instructions for modifying an audio signal, that when executed on a processor of a wearable audio device is arranged to:

receive, via at least one microphone, an audio signal from an environment comprising a voice signal of a user wearing the wearable audio device and an environmental signal;

isolate the voice signal from the environmental signal;

modify the voice signal and/or the environmental signal; and generate, via at least one audio output device arranged on, in, or in proximity to the wearable audio device, an audio output signal, wherein the audio output signal comprises a mixed audio signal comprising i) the modified voice signal with the environmental signal; ii) the voice signal with the modified environmental signal; or iii) the modified voice signal with the modified environmental signal.

19. The computer program product of claim 18, wherein a total time period between the receipt of the audio signal from the at least one microphone to the generation of the audio output signal is less than or equal to 100 milliseconds.

* * * * *